US011053672B2

(12) United States Patent
Iocco et al.

(10) Patent No.: US 11,053,672 B2
(45) Date of Patent: Jul. 6, 2021

(54) UNDERMOUNT SINK INSTALLATION APPARATUS AND METHOD

(71) Applicants: Augustine Albert Iocco, Harrison City, PA (US); Matthew Augustine Iocco, Murrysville, PA (US)

(72) Inventors: Augustine Albert Iocco, Harrison City, PA (US); Matthew Augustine Iocco, Murrysville, PA (US)

( * ) Notice: Subject to any disclaimer, the term of this patent is extended or adjusted under 35 U.S.C. 154(b) by 0 days.

(21) Appl. No.: 17/089,252

(22) Filed: Nov. 4, 2020

(65) Prior Publication Data

US 2021/0156127 A1 May 27, 2021

Related U.S. Application Data

(63) Continuation-in-part of application No. 16/691,474, filed on Nov. 21, 2019, now Pat. No. 10,907,331.

(51) Int. Cl.
*E03C 1/324* (2006.01)

(52) U.S. Cl.
CPC ..... *E03C 1/324* (2013.01)

(58) Field of Classification Search
CPC ... E03C 1/32; E03C 1/33; E03C 1/322; E03C 1/324; E03C 1/335; F16M 3/022
USPC ..... 108/147.11, 147.16, 147.17; 248/244, 248/295.11, 544; 312/140.1, 140.3, 312/140.4; 29/890.141; 4/631–635, 645, 4/647–649
See application file for complete search history.

(56) References Cited

U.S. PATENT DOCUMENTS

| | | | | |
|---|---|---|---|---|
| 515,836 | A * | 3/1894 | Mueller | E03C 1/33 4/649 |
| 1,116,091 | A * | 11/1914 | McDonald | A47B 57/567 248/244 |
| 1,299,234 | A * | 4/1919 | Russell | A47B 57/567 248/244 |
| 3,008,150 | A * | 11/1961 | Lyon, Jr. | E03C 1/335 4/650 |
| 3,813,707 | A * | 6/1974 | Fowell | E03C 1/33 4/650 |
| 4,589,170 | A * | 5/1986 | Ponting | E03C 1/335 24/456 |
| 6,105,182 | A | 8/2000 | Elnar | |
| 8,356,367 | B2 | 1/2013 | Flynn | |
| 9,290,919 | B2 | 3/2016 | Blaine | |
| 9,382,702 | B2 * | 7/2016 | Wisniewski | F16B 21/183 |
| 9,945,514 | B1 * | 4/2018 | Huang | F16M 11/105 |
| 10,053,847 | B2 * | 8/2018 | Xu | E03C 1/33 |
| 10,184,236 | B2 * | 1/2019 | Xu | E03C 1/335 |
| 2003/0154546 | A1 * | 8/2003 | Romo | E03C 1/335 4/633 |
| 2006/0253974 | A1 * | 11/2006 | Schneider | E03C 1/33 4/633 |
| 2010/0301175 | A1 * | 12/2010 | Grayson | E03C 1/33 248/27.1 |
| 2016/0319528 | A1 * | 11/2016 | Snitil | F16B 35/041 |

* cited by examiner

*Primary Examiner* — Joshua E Rodden

(57) ABSTRACT

An adjustable sink positioning and mounting apparatus for rapidly attaching sinks to the underside of a counter top includes a channel base member with means for attaching to a cabinet wall, a blade spring with an angled portion at a lower end of the channel base member, and an elongated sliding member releasably engaged with the channel base member. The sliding member includes one of teeth or threads and an arm adjacent the top end.

8 Claims, 9 Drawing Sheets

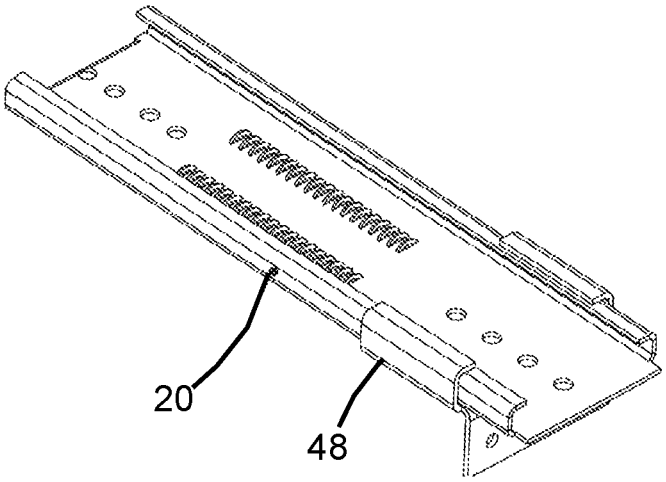
FIG. 7(c)
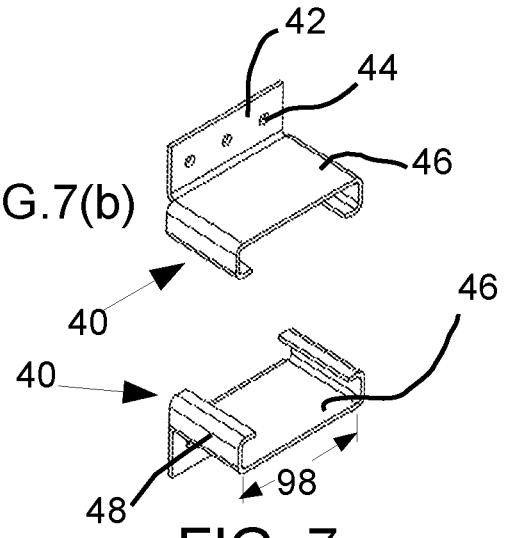
FIG.7(b)
FIG. 7(a)
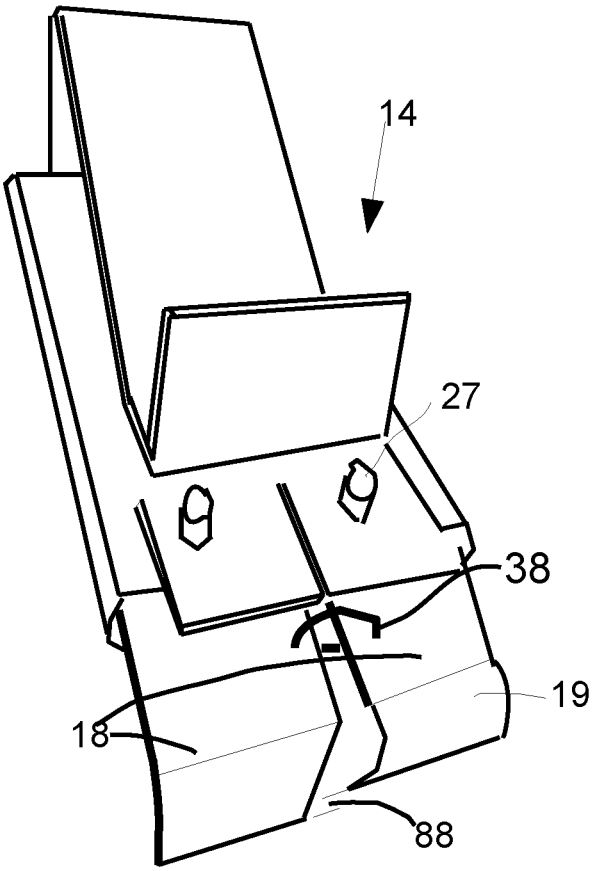
FIG. 8

UNDERMOUNT SINK INSTALLATION APPARATUS AND METHOD

CROSS REFERENCE TO RELATED APPLICATION

The present application is a continuation-in-part of and claims the benefit of pending non-provisional application Ser. No. 16/691,474 filed on Nov. 21, 2019, which in turn claims benefit to non-provisional application Ser. No. 16/510,902, filed Jul. 13, 2019, now U.S. Pat. No. 10,563,387.

FIELD OF THE INVENTION

The present invention relates, in general, to the attachment of sinks under counter tops, and more particularly, this invention relates to the rapid mounting and securing of under-mount sinks.

BACKGROUND OF THE INVENTION

The attaching of under-mount sinks beneath counter tops has always been laborious and time consuming. There are many methods and a variety of installation techniques. The many models of sinks available in the market place pose different types of installation techniques. Information relevant to attempts to address this problem can be found in a few exemplary types of cross members. One suitable for the purpose of supporting sinks is described in U.S. Pat. No. 7,429,021. Another exemplary cross member suitable for use as a sink support is described in U.S. Pat. No. 5,538,206. But none of these examples of prior art have addressed the supporting of the sides and front of a sink in a rapid and secure manner. Blaine in U.S. Pat. No. 9,290,919 discloses a fixed length support member that can be fastened at one end to a cabinet wall such as to hold up undermount sinks, but with no adjustment provisions once installed. In U.S. Pat. No. 6,105,182, Elnar teaches a ratchet bracket with two columns of teeth. Elnar discloses that the purpose of the two rows is to provide added durability and support strength by supporting the bottom edge of the sliding piece with two teeth simultaneously.

SUMMARY OF THE INVENTION

The present invention provides an apparatus and method of adjustably securing a sink to the bottom of a counter top and includes an elongated sliding member movably engaged with a tubular member which is configured for attachment to a cabinet wall beneath a counter top. A column of ratchet teeth or threads on the elongated sliding member allows upward movement within the tubular member but downward movement is prohibited by an angled blade spring fixed on a channel base member configured for attachment to the cabinet wall. The elongated sliding member includes a sink-contact arm at an upper end.

OBJECTS OF THE INVENTION

It is, therefore, one of the primary objects of the present invention to provide a fast, easy, effective, efficient, simple and economical way of attaching and reliably securing an undermount sink to a countertop.

Another object of the present invention is to provide a self contained way of attaching a sink-support bracket requiring no external drilling, tapping, screwing, bolting, threading or adhesives while allowing the end user the option of securing the bracket by screws.

Still another object of the present invention is to provide 180° range of horizontal pivoting of the arm that will engage the sink flange to accommodate various size gaps between a cabinet wall and a sink flange.

An additional object of the present invention is to provide a faster action of adjustable vertical range of motion to engage the bracket with the sink flange by way of a sliding ratchet mechanism, and yet provide a release means if needed.

Still another object of the present invention is to provide enhanced variable height adjustment, which allows the sink to be cradled below the countertop. This permits a rapid and convenient sink installation method with an open window for the application of sink sealant. The sink is then raised to meet with the bottom of the countertop.

An additional object of the present invention is to provide a narrow-profile version of a bracket to support a sink where there is little clearance to work in the front region of the sink and side walls of the cabinetry.

Yet another objective is to include an alternate design feature in a sliding ratchet assembly with finer adjustment of height than a typical ratchet device would offer.

In addition to the various objects and advantages of the present invention described with some degree of specificity above, it should be obvious that additional objects and advantages of the present invention will become more readily apparent to those persons who are skilled in the relevant art from the following more detailed descriptions of the invention, particularly, when such description is taken in conjunction with the attached drawing figures and with the appended claims.

BRIEF DESCRIPTION OF THE DRAWINGS

FIGS. 7(*a*), (*b*) and (*c*) provide perspective views of an optional adapter for the present invention.

FIG. 8 provides a perspective view of an alternative embodiment of the present invention.

Figure 1:
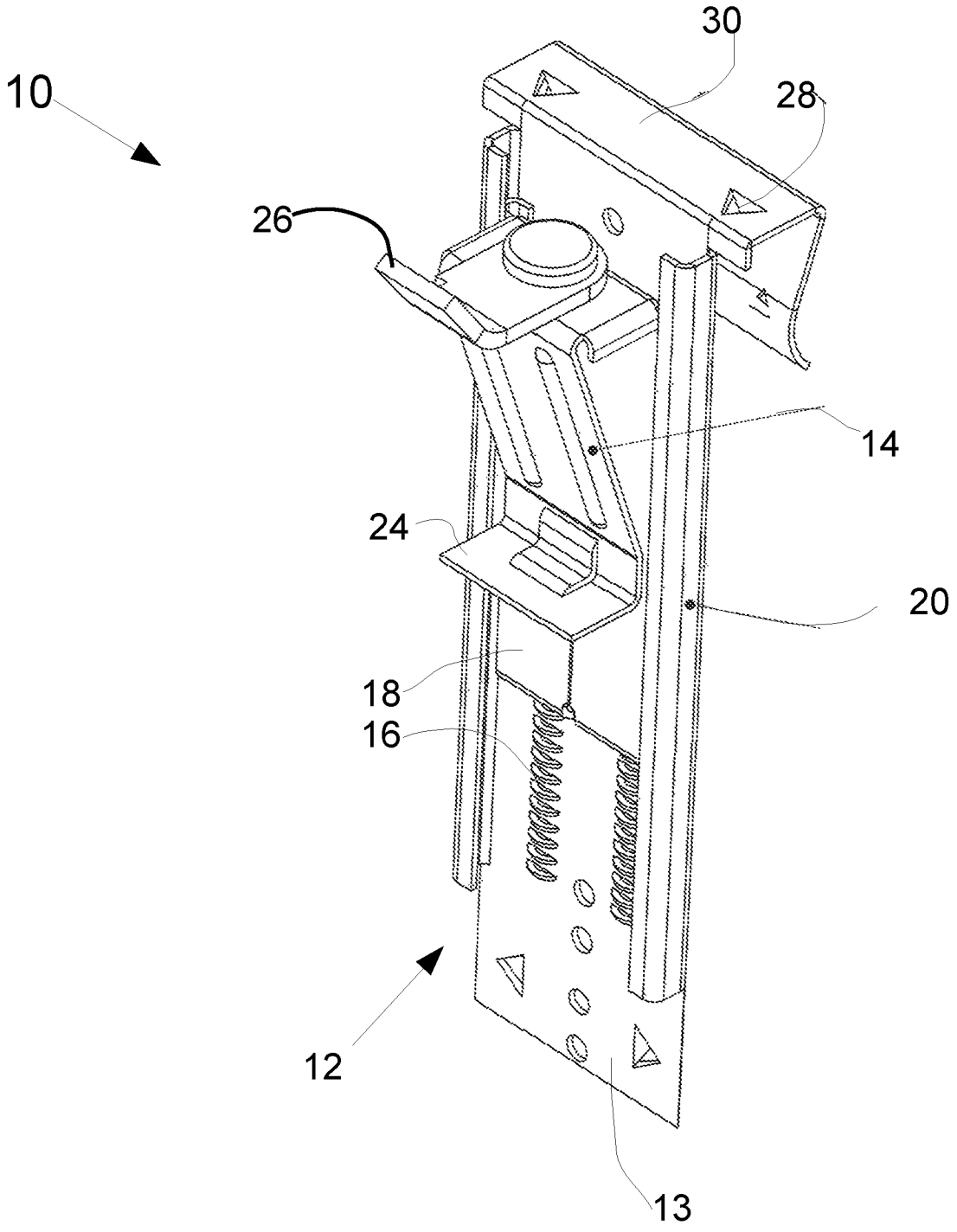
FIG. 1 illustrates a perspective side elevation view of a preferred embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the figures. An exception is the prior art FIG. 5.

Referring initially to FIG. 1, this provides a perspective view of a preferred embodiment of the present sink support bracket invention in use generally shows as 10. An elongated channel base member 12 has at a top end a inward curving thin gauge metal clip 30 fixed to the top of the back plate 13 of the channel base member 12, configured to compresses inward against a side cabinet wall compressing the wood cabinet. Metal clip 30 is pretensioned and is adjustable to meet different cabinet wall thicknesses, and in this same area are two points of no return one way stab-locks locks 28. The top of the bracket has two stab locks 28 to engage the top of the cabinet wall, this is to prevent sag when there is a load on arm 26. There are also two hammer-in type stab locks 28, adjacent the bottom end of the base member 12, to prevent counter rotation when there is a load on the sink-contact arm 26 in the fully retracted position. This method of attachment requires no external fasteners. The installed bracket is held in place vertically by the weight of the countertop and the stab locks. The main body of the base member 12 also includes at least one column of vertically oriented ratchet teeth 16 having a plurality of teeth 16 through a pair of parallel outwardly facing spaced apart columns of peripheral louvers or protrusions 16. By ratchet teeth is meant they permit movement across them in one direction, but not the other unless special methods are utilized. The two columns preferably have the teeth staggered in horizontal misalignment for finer adjustment of height as explained further later. The sled member 14 adjusts vertically with at least one blade spring 18 at the bottom end, but preferably two, with curved tips that engage on the teeth 16 of the channel base member when sliding upward, but prevents downward movement. By blade spring is meant a strip of preselected semi-flexible material with a predetermined thickness and a free end that can be temporarily flexed from its resting position but then return when released to its original resting position. This contrasts with semi-flexible materials that when bent substantially remain essentially in the new position. Herein, the semi-flexible material can be either metal or plastic. Preferably, the preselected material is a high-carbon spring steel with a preselected thickness in the range of 0.3 to 0.7 mm. Any thinner than the low end of the range would probably make it too weak to support the load above, and above the top of the range it would be too resistant to manual pushing of the sled. Any use of power tools would tend to lift the counter top excessively. At the top end of the sled member 14 is a sink-contact arm 26, which preferably has an upward curving tip and an 180° adjustable horizontal range of pivot motion to engage the rim of the sink depending of the gap to the cabinet wall.

Figure 2:
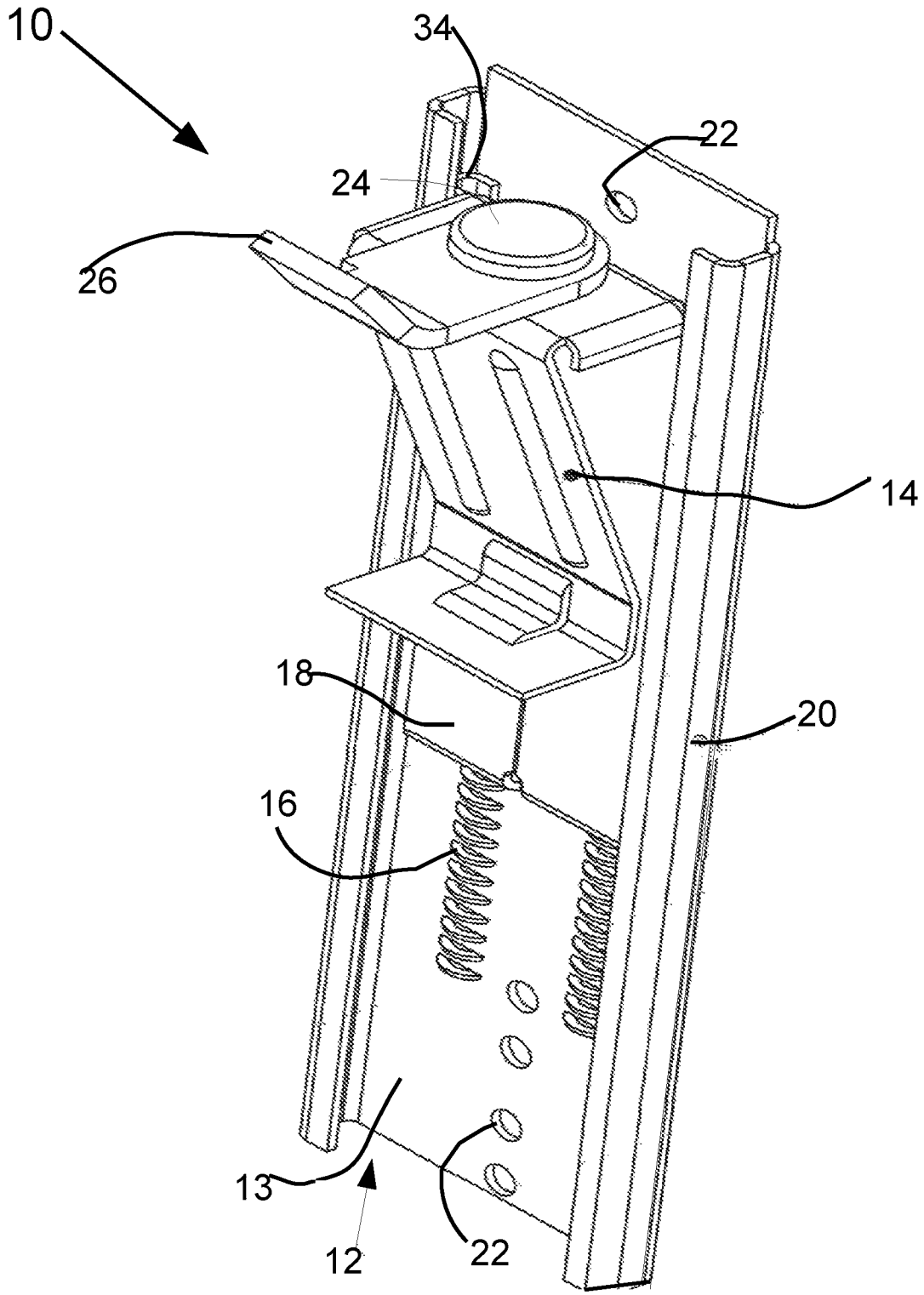
FIG. 2 provides a perspective view of an alternative embodiment of the present invention with a different method of wall attachment.

FIG. 2 provides a perspective profile view of an alternative embodiment of the present invention with a different method of wall attachment. The main body 12 shown without clip includes mounting apertures 22 in the planar back plate of the base member 13 that secures to a vertical surface by way of mounting screws (not shown) through the apertures 22. It is preferable but optional to have one or more adhesive pads (not shown) on the back side for ease of installation. This gives the end user the option to secure the device to a cabinet wall where the clip-on version shown in FIG. 1 cannot be used. This figure also shows the preferred curved longitudinal edges 34 the sled member 14 configured for sliding engagement with the edge channels 20 of the channel base member 13.

Figure 3:
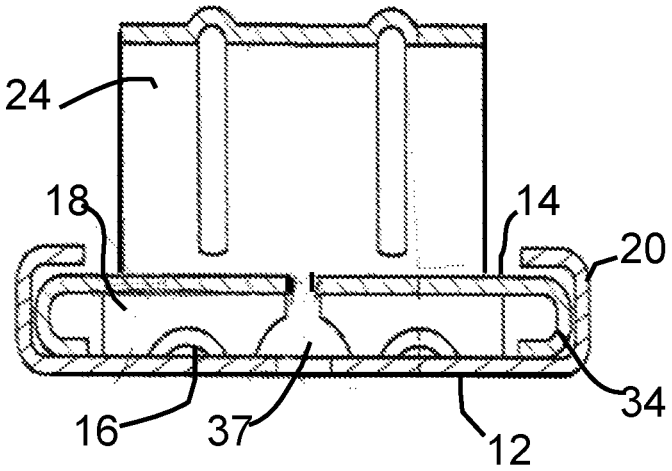
FIG. 3 provides a bottom end view of a key feature of the present invention.

FIG. 3 provides a bottom end view of a key feature for both embodiments of the present invention. The importance of this would not be obvious until one attempts to lower the sled member for height adjustment or removal of the sink because the ratchet teeth 16 inhibit downward movement, just upward. To release the blade springs 18 of the sled member 14, a screwdriver or other tool is inserted in the notch opening 37 between the two curved tips and pried outward to temporarily release the curved ends of the blade springs 18 from the teeth 16. With just blade spring, the notch 37 is cut into the curved bottom of the blade spring 18. Pulling down the lower flange 24 on the sled member 14 enables lowering the sled member while the foot tabs are still pried up. Removing the tool allows the foot tabs to re-engage with the ratchet teeth, or the sled member to be completely separated from the ratchet channel bracket.

Figure 4:
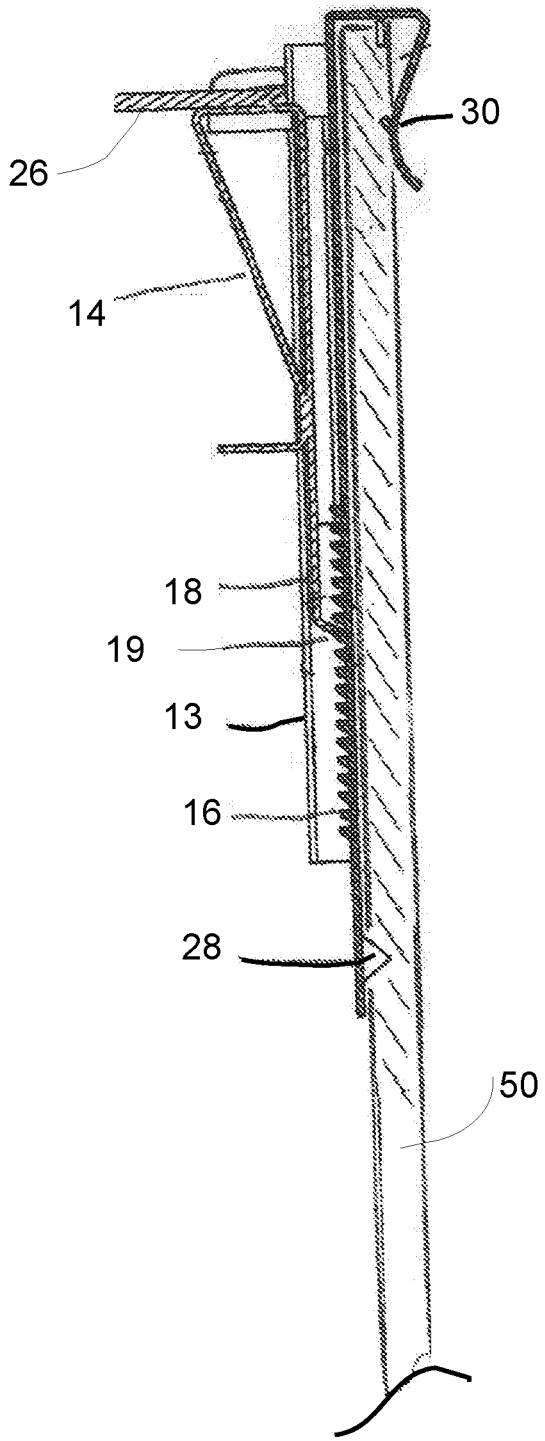
FIG. 4 is a side sectional elevation view of the preferred embodiment.

FIG. 4 is a side sectional elevation view of the preferred embodiment including the top clip 30. This view also shows the curved tip 19 of the blade spring 18 which is the lower part of the sled member 14 in other figures. It also shows how the clip 30 engages the top of the cabinet wall 50, and the stab-locks 28 are forced into the wall.

Figure 5:
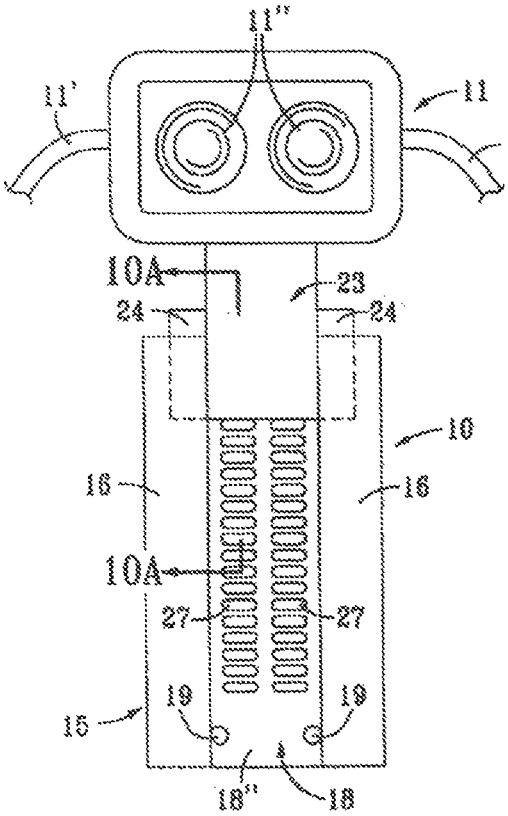
FIG. 5 (PRIOR ART)
FIG. 5 provides an elevation view of a prior art ratchet bracket.

FIG. 5 provides an elevation view of a prior art ratchet bracket. Elnar in the previously-referenced patent teaches using two rows of ratchet teeth (indentations) for "greater reliability and durability" (col. 4, line 34). The bottom edge of the slider portion 24 shows that the top edge of the teeth 27 in each row are in lateral alignment. This arrangement allows for two points of support contact to provide more reliable load support. However, the next level of support must be one full increment of tooth height, which by the nature of ratchet teeth must be a certain finite increment. Sometimes, one level may not provide tight-enough support, but the next level may be too far up.

Figure 6:
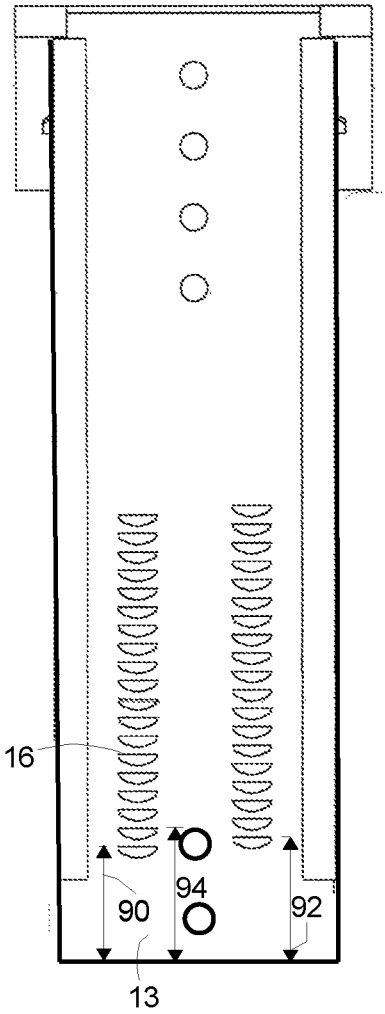
FIG. 6 is an elevation view of a key element of the present invention.

FIG. 6 is an elevation view of a key element of the present invention: the bracket plate 13 with two columns of ratchet teeth 16. In contrast with Elnar, the teeth in one column herewith are purposely in staggered misalignment horizontally with the opposing tooth in the other column. It can be further explained by noting that the height of the top edge of the first tooth from the bottom on the right is at a height 92 intermediate between the heights of the bottom two on the left, 90 and 94. This is a significant feature because it provides finer adjustment of height as the sliding member is pushed upward. The teeth must have a finite height to function, and that sets a certain minimum increment in height as the sliding member is pushed up and one blade springs engages a ratchet tooth on one side and subsequently the other blade spring engages with a tooth on the opposite column on ratchet. However, with the second column of teeth offering a shorter increment relative to the first column, the next increment of supported height is about half as much. The device of Elnar cannot provide this, and in fact teaches away from it by emphasizing greater support strength.

FIGS. 7(*a*), 7(*b*) and 7(*c*) provide perspective views of an optional adapter 40 for the present invention. The width 98 of channel 46 is such that it engages operably over the edge rails 20 of the channel base member. There is a flange portion 42 at a right angle to the channel 46 and with 2 or more apertures in the flange portion 42. The use of this optional adapter become advantageous when helping to secure an undermount sink that is already installed, but now loosened from the underside of the counter top. Due to the narrow clearance between the sink and the inside front of the cabinet, it helps very much to first install the adapter plate 40 via the flange portion 42. The adapter plate 40 is attached to the underside of the cabinet in the front with the flange portioned screwed onto the top wooden rim. The channels 20 of the base member slide into the channels 46 of the installed adapter plate 40 as shown in FIG. 7(*c*) and assists in holding it there until the lower screws are put into the cabinet front wall. The channel base member 20 includes at least one column of teeth 26.

FIG. 8 provides a perspective view of an alternative embodiment of the sled portion 14 of the present invention. The blade springs 18 in this variation are non-integral and made of a semi-bendable leaf spring sort of a preselected material, typically high-carbon steel. This is so that they will slide more readily over the teeth as the sled 14 is pushed up into place. They are held in place with fasteners 27 such as rivets or bolts. In case the sled needs to be lowered, it can be released temporarily from the teeth with a prying means that can be operably engaged with a screwdriver. The means may be a ring or hoop 38, or a notch 37 as shown in FIG. 3. In addition, an alternative means of enabling finer tuning of the height is for one curved tip of one foot tab 18 to be marginally longer by a predetermined gap 88. The gap 88 is about half of the spacing between top edges of the teeth. If 88 was equal to the gap between teeth, there would be no finer adjustment.

Figure 9:
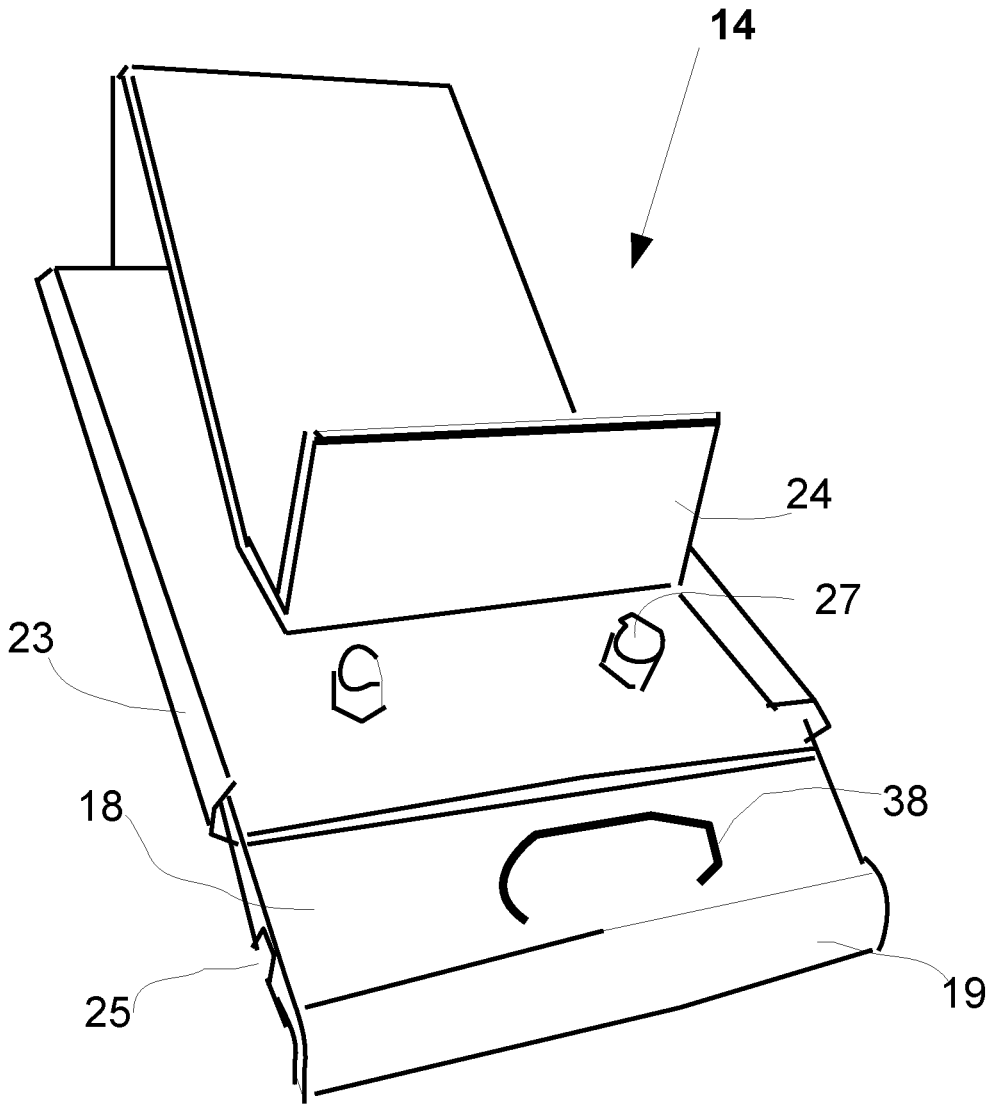
FIG. 9 provides a perspective view of an alternative embodiment of the sled member of the present invention.

FIG. 9 provides a perspective view of an alternative embodiment of the sled member 14 of the present invention. In this variation, the blade spring 18 is a single unit with a single angled portion 19. The blade spring 18 can be integral with the rest of the sled member 14 or attached with fasteners 27. The prying means to release the curved 19 from the ratchet teeth (not shown) is a ring 38 under which a screwdriver can fit and be used to lift the blade spring 18 away from the ratchet teeth. An optional feature is a reduced thickness portion 25 that is configured to reduce the force needed to bend the tips and thus reduce the upward force necessary.

Figure 10:
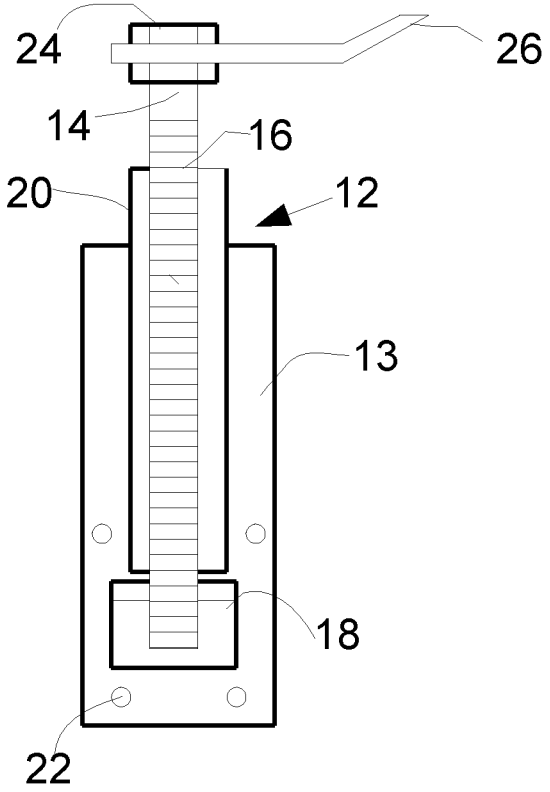
FIG. 10 is a front elevation view of an alternative embodiment of the present invention.

FIG. 10 is a front elevation view of an alternative embodiment of the present invention. An elongated channel member 12 includes a channel with curved edges, 20, fixed to a planar base plate 13. A sliding member 14 has a multitude of teeth or threads 16. A sink support arm with a curved tip 26 is pivotably connected to the top end of the sliding member 14. At least two apertures 22 in the mounting plate 13 allow for secure mounting to a cabinet wall with screws, nails or bolts. The teeth 16 on the sliding member 14, in this example a rod, can slide over a portion of blade spring 18 on the back plate 13 as it is pushed upward, but both 14 and 18 are configured to not allow movement of the sliding member 14 downward. This is better shown on FIG. 11. By blade spring herein is meant a strip of semi-rigid material that will flex in one direction under force and return to original position when force is released.

Figure 11:
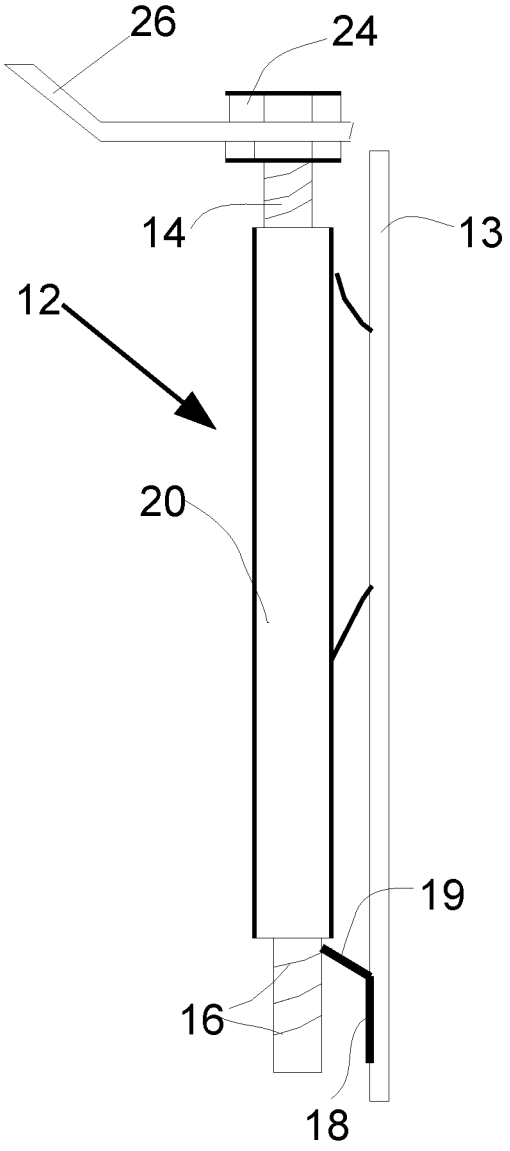
FIG. 11 presents a side elevation view of the alternative embodiment of FIG. 10.

FIG. 11 presents a side elevation view of the alternative embodiment of FIG. 10. The spring blade 18 fixed to the back plate 13 has a curved or angled portion 19 to allow engagement with the teeth 16 on the sliding member 14, which in the example shown is a threaded cylindrical rod, but it could also have a square or cross section with teeth or notches along at least one side. Preferably, the distal end of the angled portion 19 is generally tapered like a knife edge for better engagement with threads. The combination of teeth 16 and spring blade 18 are configured to permit unidirectional movement by manual force. The curved lateral edges 20 of the channel member 12 restrict movement of the sliding member 14 other than for free movement upward. While not the preferred mode, the cylindrical or interior of the channel 20 may also be threaded such that the threaded rod 14 can be screwed up or down. The curved-tip arm 26 is free to pivot at the top rivet or bolt 24 such that the underside rim of a sink being supported can be engaged at various distances from a cabinet wall.

Figure 12:
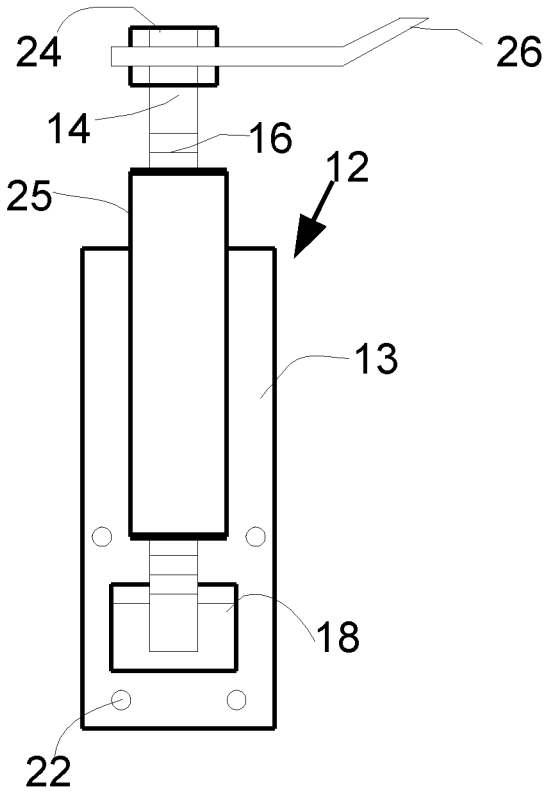
FIG. 12 is a front elevation view of another alternative embodiment of the present invention.

FIG. 12 is a front elevation view of another alternative embodiment of the present invention generally shown as 11, with the main difference being the channel is now an enclosed hollow tubular member 25. The blade spring 18 fixed to the planar back plate 13 on channel base member 12 has a curved or angled portion 19 to allow engagement with the teeth or slots 16 on the sliding member 14, which in the example shown is a threaded rod. Preferably, the distal end of the angled portion 19 is generally tapered like a knife edge for better engagement with threads or notches. The combination of teeth 16 and spring blade 18 are configured to permit unidirectional movement by manual force. The sliding member 14 is configured to fit loosely inside the tubular member 25 yet still restricts movement of the sliding member 14 other than for free movement upward. The tubular member 25 may be either cylindrical or square. Optionally, the curved-tip arm 26 is free to pivot at the top rivet or bolt 24 such that the underside rim of a sink being supported can be engaged at various distances from a cabinet wall.

Figure 13:
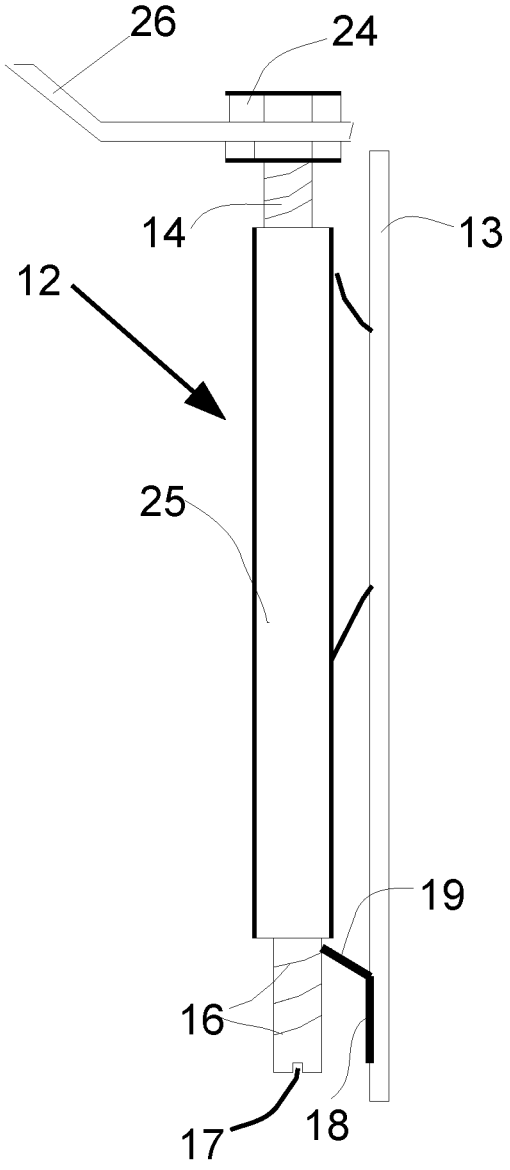
FIG. 13 presents a side elevation view of the alternative embodiment of FIG. 12.

FIG. 13 presents a side elevation view of the alternative embodiment of FIG. 12. The spring blade 18 fixed to the plate of elongated channel member 13 has a curved or angled portion 19 to allow engagement with the teeth 16 on the sliding member 14, which in the example shown is a threaded rod. Preferably, the distal end of the angled portion 19 is generally tapered like a knife edge for better engagement with threads. The combination of teeth 16 and blade spring 18 are configured to permit unidirectional movement by manual force. Preferably, the spring blade can be flexed upward with a tool to allow for downward repositioning of the sliding member. The walls of the tubular member 12 restrict movement of the sliding member 14 other than up or down. While not the preferred mode, the interior of a cylindrical tubular member 25 may also be threaded such that the threaded rod 14 can be screwed up or down using bottom slot 17. Optionally, the curved-tip arm 26 is free to pivot at the top rivet or bolt 24 such that the underside rim of a sink being supported can be engaged at various distances from a cabinet wall. Another option is to have a top-end metal clip much like 30 in FIG. 1.

What is claimed is:

1. An adjustable support apparatus for under-mount sinks comprising:

a) an elongated channel base member configured for attachment to a cabinet wall wherein, the elongated channel base member includes a planar back plate, and an elongated tubular portion, and wherein said planar back plate also includes a blade spring with an angled portion; and, b) an elongated sliding member configured to movably engage within walls of said elongated tubular portion, wherein said sliding member has multiple teeth engageable with the blade spring angled portion.

2. The adjustable support apparatus of claim 1, wherein said sliding member is a threaded rod.

3. The adjustable support apparatus of claim 1, wherein a top arm of said sliding member has an upwardly curved distal end and a pivoting means.

4. The adjustable support apparatus of claim 1, wherein said elongated tubular portion is an elongated square tube.

5. The adjustable support apparatus of claim 2, wherein said threaded rod is a square-end rod.

6. The adjustable support apparatus of claim 2, wherein said threaded rod is a cylindrical rod with a slot at a lower end.

7. The adjustable support apparatus of claim 1, wherein said blade spring of said sliding member is made of a high-carbon steel with a thickness between 0.3 and 0.7 millimeters configured for resilient bending in one direction only under force.

8. The adjustable support apparatus of claim 1, wherein said at least one blade spring includes a reduced-thickness portion configured to reduce bending force without substantially reducing support strength.

* * * * *